US007237922B2

(12) United States Patent
Cayton

(10) Patent No.: US 7,237,922 B2
(45) Date of Patent: Jul. 3, 2007

(54) PUMPKIN ILLUMINATION STAKE

(75) Inventor: Paul E. Cayton, Stratford, CT (US)

(73) Assignee: Howler Brands, LLC, Southport, CT (US)

( * ) Notice: Subject to any disclaimer, the term of this patent is extended or adjusted under 35 U.S.C. 154(b) by 98 days.

(21) Appl. No.: 11/174,704

(22) Filed: Jul. 5, 2005

(65) Prior Publication Data

US 2007/0008718 A1 Jan. 11, 2007

(51) Int. Cl.
*F21L 4/00* (2006.01)

(52) U.S. Cl. ..... 362/186; 362/311

(58) Field of Classification Search ..... 362/186
See application file for complete search history.

(56) References Cited

U.S. PATENT DOCUMENTS 4,678,450 A * 7/1987 Scolari et al. ..... 446/405
4,698,732 A * 10/1987 Hickey ..... 362/154
5,091,833 A 2/1992 Paniaguas et al.
5,279,513 A * 1/1994 Connelly ..... 446/219
5,321,591 A * 6/1994 Cimock et al. ..... 362/186
5,918,964 A 7/1999 Bou
5,947,789 A * 9/1999 Chan ..... 446/219
6,371,625 B2 * 4/2002 Campman ..... 362/184
6,513,945 B1 2/2003 Wyss et al.
6,540,371 B2 * 4/2003 Franks ..... 362/122
6,612,712 B2 * 9/2003 Nepil ..... 362/101
6,705,741 B2 3/2004 Bonnema et al.
2003/0189825 A1 10/2003 Tauch et al.
2003/0210555 A1 11/2003 Cicero et al.
2004/0098894 A1 * 5/2004 Thomas ..... 40/586
2006/0245196 A1 * 11/2006 Haynes ..... 362/351

* cited by examiner

*Primary Examiner*—Ali Alavi
*Assistant Examiner*—Hargobind S. Sawhney
(74) *Attorney, Agent, or Firm*—McCarter & English, LLP

(57) ABSTRACT

Lighting units for use in a variety of enclosures/containers, such as Jack-O-Lanterns formed from hollowed-out pumpkin gourds, that define an interior region for receipt of a lighting unit, are provided. The enclosure/container and the lighting unit are combined to achieve a desired illumination effect, e.g., consistent with a holiday and/or seasonal theme. The lighting unit generally includes an elongate lighting element which can be placed in a number of different illumination modes, a hilt/handle to which the elongate lighting element is attached, and a control switch located on the handle for actuation by a user. A tip of the elongate lighting element is placed against the skin of the Jack-O-Lantern pumpkin, the tip being sized and shaped to permit itself and at least an adjacent part of the elongate lighting element to be pushed through the pumpkin flesh to depth of the hilt for internal illumination of the Jack-O-Lantern.

29 Claims, 4 Drawing Sheets

PUMPKIN ILLUMINATION STAKE

BACKGROUND

1. Technical Field

The present disclosure relates to internal illumination of enclosures/containers having holiday/seasonal themes and, more particularly, to a system and method for illuminating Halloween-themed Jack-O-Lantern pumpkins.

2. Background Art

Pumpkins have long been an important part of the Halloween holiday. The yearly tradition of hollowing-out and creatively carving pumpkins to transform them into Jack-O-Lanterns is as popular as ever. An essential aspect of the Jack-O-Lantern is the internal lighting thereof which naturally attracts attention and creates an interesting and aesthetically pleasing visual effect. Wax candles have commonly been utilized for this purpose, as have other items which provide light via an open flame.

Increasingly, however, carvers of home-made Jack-O-Lanterns are choosing non-flame or artificial light sources, such as incandescent light bulbs or light-emitting diodes, to illuminate their creations. While this trend may have arisen out of a desire for increased safety, the wide variety of creative and attractive devices and systems now available for non-flame illumination of the humble Halloween pumpkin points to a broader appeal. Such broad appeal may, for example, be based on a demand for more and different lighting options to suit individual preferences, to inspire creativity, or simply to provide amusing diversions.

Artificial lighting devices for pumpkin-type Jack-O-Lanterns are known. In U.S. Pat. No. 6,513,945 to Wyss, et al., a translucent or transparent artificial stem, prepared for attachment to a pumpkin in replacement of the pumpkin's natural stem, is described. The artificial stem, which attaches to the pumpkin via adhesive is provided with a cavity. The cavity in the artificial stem enables the insertion of a small, tubular shaped chemiluminescent lighting device or "light stick", which lighting device temporarily generates luminescent light for illuminating the artificial stem by virtue of being inserted therein. Also described in the Wyss et al. '945 patent is a decorative replacement stem formed of an optically transparent glass or acrylic, with attachment means by extension of a pointed base into a pumpkin's hollow center or interior. The replacement stem tends to emit light at its remote edges which is picked up from any source which may be located within the interior volume space of the pumpkin, such as a candle or light bulb.

Disclosed in U.S. Pat. No. 5,091,833 to Paniaguas et al. is a kit for creating a face on a pumpkin so as to produce a Jack-O-Lantern. The kit includes a plurality of illuminating units, each of which is equipped with a battery and a light bulb; and a plurality of translucent facial elements such as an eye, a mouth, an ear, etc., each of which is screwed onto a respective one of the illuminating units. Each facial element envelops and surrounds the respective light bulb so that light from the light bulb is transmitted through the facial element and thereafter emitted from an external surface of the facial element. Each of the illuminating units includes a spear-like pointed base which is pushed into the flesh of the pumpkin in order to mount the respective illuminating unit on the pumpkin. The extreme end forms a sharp angle to facilitate penetration of the pumpkin flesh.

Other references disclose various means by which illumination devices are mounted within a hollow pumpkin via embedding one or more suitable structures into the flesh of the interior walls of the pumpkin. For example, U.S. Patent Application Publication No. 2003/0210555 to Cicero et al. discloses a decorative lamp equipped with multiple prongs designed to permit the lamp to be embedded into the flesh of the pumpkin below the stem thereof. At least partially similar structure is disclosed in each of U.S. Patent Application Publication No. 2003/0189825 to Tauch et al., U.S. Pat. No. 6,705,741 to Bonnema et al., and U.S. Pat. No. 5,918,964 to Bou.

Despite efforts to date, a need remains for attractive and creative artificial lighting units that are configured and dimensioned for internal illumination of pumpkin-type Jack-O-Lanterns, and that are both safe and convenient to use.

SUMMARY OF THE DISCLOSURE

The present disclosure provides advantageous lighting units for use in a variety of enclosures/containers to achieve a desired illumination effect. The enclosures/containers are susceptible to illumination from within, and typically define an interior region for receipt of a lighting unit. According to exemplary embodiments of the present disclosure, a Jack-O-Lantern pumpkin and a lighting unit are combined to achieve an illumination effect pursuant to a Halloween theme.

According to one such exemplary embodiment, a lighting unit is provided which includes an elongate lighting element defining a tip, a hilt to which the elongate lighting element is coupled and which defines a stop, and a controller for controlling the elongate lighting element. The tip of the elongate lighting element is adapted to permit an adult human to manually push the tip and an adjacent portion of the elongate lighting element into and through the previously intact outer flesh of a pumpkin gourd to a depth defined by a stop of the hilt. In alternative embodiments, the elongate lighting element may function to dilate an opening in the pumpkin wall which is initiated with a sharp instrument, e.g., a knife. The control switch remains located externally to the Jack-O-Lantern so as to permit a user to operate the lighting unit without opening a lid of the Jack-O-Lantern.

According to other exemplary embodiments of the present disclosure, a combination is provided by which a lighting unit such as is described above is used to illuminate a Jack-O-Lantern pumpkin. Variations of such combinations include Jack-O-Lanterns formed from real as well as from artificial (e.g., plastic) pumpkins.

According to further exemplary embodiments of the present disclosure, a method is disclosed by which a lighting unit such as is described above is inserted into a Jack-O-Lantern formed from a hollowed-out pumpkin gourd via penetration of the flesh of the pumpkin and creation of an appropriately-sized hole, followed by external actuation of the control switch for internal illumination of the Jack-O-Lantern.

The disclosed lighting units and combinations have a variety of applications and implementations, as will be readily apparent from the disclosure provided herein. Additional advantageous features and functionalities associated with the present disclosure will be apparent from the detailed description which follows, particularly when read in conjunction with the figures appended hereto.

BRIEF DESCRIPTION OF THE DRAWINGS

For a more complete understanding of the present disclosure, reference is made to the following detailed description of various exemplary embodiments thereof, considered in conjunction with the accompanying drawings, in which.

DETAILED DESCRIPTION OF EXEMPLARY EMBODIMENT(S)

Figure 1:
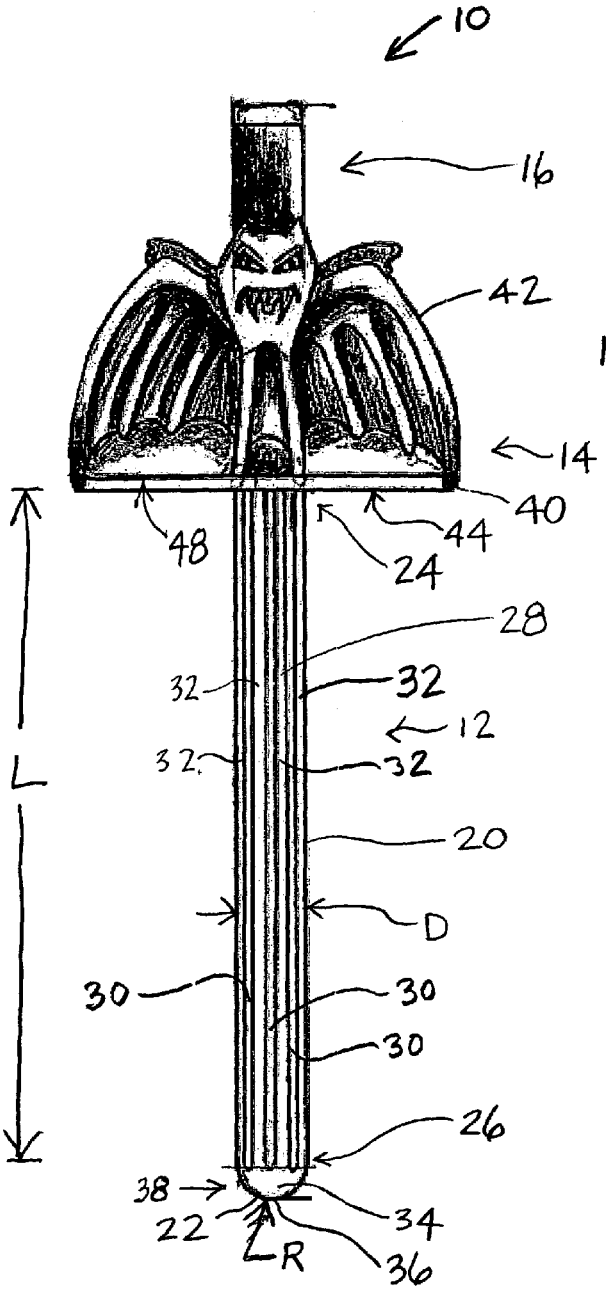
FIG. 1 is a front elevational view of a lighting unit in accordance with an exemplary embodiment of the present disclosure.
Figure 2:
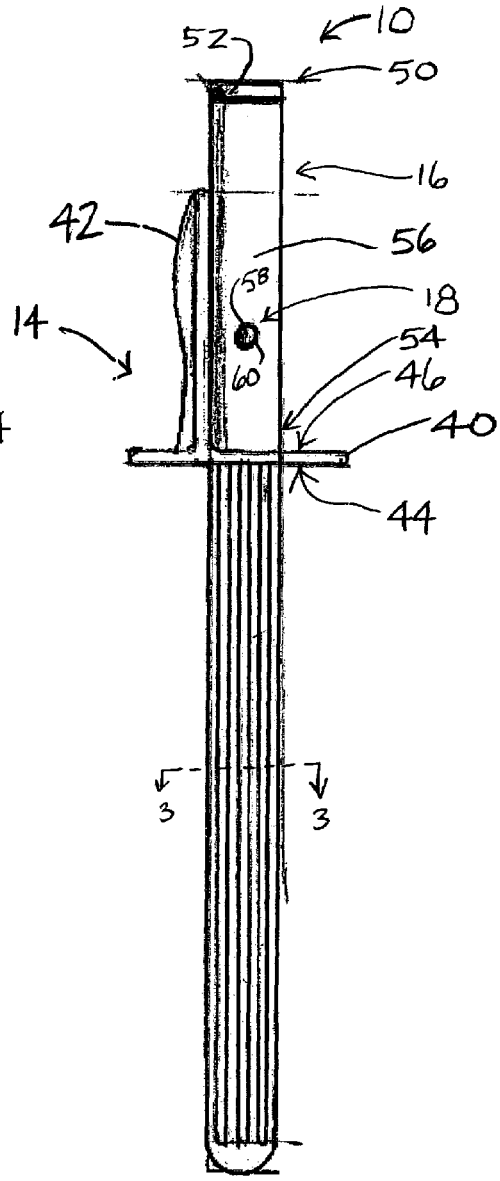
FIG. 2 is a side elevational view of the lighting unit of FIG. 1.
Figure 3:
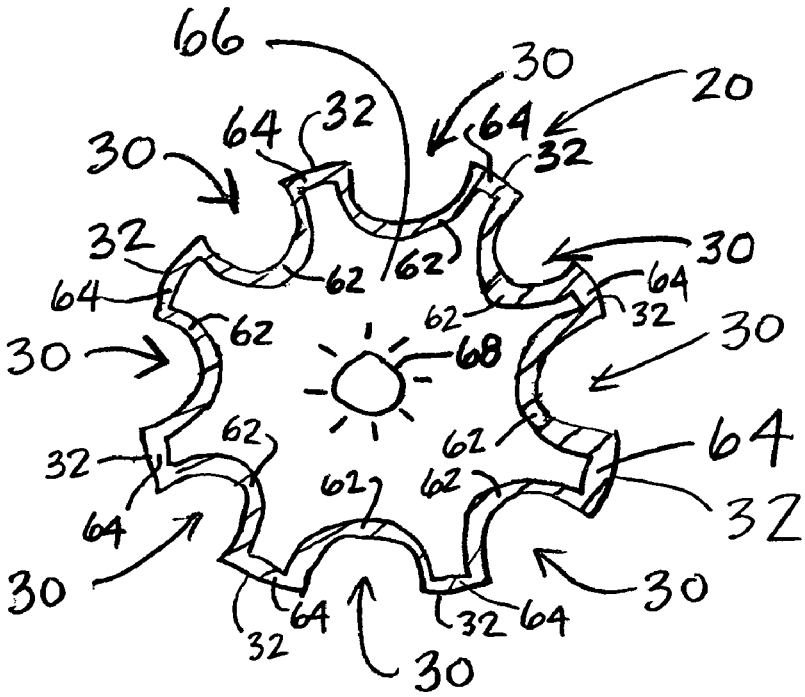
FIG. 3 is a top cross-sectional view of the lighting unit taken along lines 3-3 of FIG. 2.

An exemplary embodiment of an advantageous lighting unit in accordance with the present disclosure is depicted in FIGS. 1-3. With reference to FIGS. 1-2, an exemplary lighting unit 10 according to the present disclosure is depicted which, when at least partially inserted through the flesh of a pumpkin Jack-O-Lantern and into the hollow interior of same, is used to directly illuminate the Jack-O-Lantern from within. The lighting unit 10, which may have the outward appearance of a stake or toy sword, includes an elongate lighting element 12, a hilt 14, a handle 16, and a control switch 18. Alternative external appearances/themes (e.g., non-sword appearances) may be employed without departing from the spirit or scope of the present disclosure, e.g., serpent and/or snake-like appearances, arrow-like appearances, and/or abstract/futuristic appearances.

The elongate lighting element 12 is typically made of plastic (in whole or in part), and generally includes a rod-like section 20 and a tip 22. The rod-like section 20 is joined with respect to a hilt region 24. In hilt region 24, the rod-like section 20 is coupled to the hilt 14. The tip 22 of the elongate lighting element 12 is disposed or defined at a tip end 26 of the rod-like section 20.

The rod-like section 20 includes an outer surface 28 which is generally substantially cylindrical. In exemplary embodiments of the present disclosure, the rod-like section 20 is characterized by a diameter D of approximately 0.5 inches, although alternative diameters may be employed without departing from the spirit or scope of the present disclosure. Indeed, although the exemplary lighting unit of FIG. 1 features a rod-like section 20 of substantially uniform cross-section along its length, non-uniform cross-sectional designs may be employed. According to the exemplary embodiment of FIG. 1, the outer surface of rod-like section 20 includes axially aligned fluting which defines a plurality of channels 30 which are formed in the outer surface 28. The channels 30 are arranged in spaced relation around the circumference of the rod-like section 20.

In the exemplary embodiment of FIG. 1, each of the channels 30 is aligned in a substantially axial/parallel orientation. However, the channels/flutes may be arranged/oriented in an alternative, e.g., in a substantially helical manner, along the axis of rod-like section 20. Again, according to the exemplary embodiment of FIG. 1, each channel 30 extends substantially the entire length "L" of the rod-like section 20. Accordingly, the outer surface 28 of the rod-like section 20 of exemplary light unit 10 does not define a perfectly arcuate surface; rather, the outer surface 28 is segmented into a plurality of elongate surfaces 32. The significance and function of the channels 30 and the elongate surfaces 32 of the rod-like section 20 in the exemplary embodiment of FIG. 1 are discussed in greater detail hereinafter.

The tip 22 of the elongate lighting element 12 is generally of substantially unitary construction with the rod-like section 20. According to the exemplary embodiment of FIG. 1, tip 22 includes or defines a rounded surface 34 that is substantially hemispheric in shape, characterized by a radius "R" of approximately 0.25 inches, although alternative geometric dimensions may be employed without departing from the spirit or scope of the present disclosure. The rounded surface 34 typically defines an apex 36 which constitutes a distal end 38 of the elongate lighting element 12. Each of the elongate surfaces 32 of the rod-like section 20 typically extends to and meets the rounded surface 34 at the widest point thereof, such that each elongate surface 32 is substantially tangentially oriented with respect to the rounded surface 34. This affords the elongate lighting element 12 a substantially smooth overall profile from the hilt end 24 of the rod-like section 20 to the distal end 38 of the elongate lighting element 12. In alternative embodiments of the present disclosure, elongate surfaces 32 may terminate at a spaced location relative to rounded surface 34 (or may terminate at non-uniform distal locations). The significance and function of the overall smooth profile of the elongate element 12, and of the exemplary hemispheric shape of the rounded surface 34 of tip 22, are discussed in greater detail hereinafter.

The hilt 14 of the lighting unit 10 includes a base 40 and an emblem, design or aesthetic structure 42 mounted on or formed with base 40. In the exemplary embodiment of FIG. 1, base 40 is substantially planar in shape and relatively broad compared to a diameter "D" of the rod-like section 20. In addition, base 40 is typically oriented transversely with respect to the elongate lighting element 12. Exemplary base 40 includes a substantially planar lower surface 44 in which region elongate lighting element 12 forms its attachment with or to the hilt 14, and an upper surface 46 opposite the lower surface 44. As shown in FIGS. 1 and 2, exemplary structure 42 is relatively flat, and includes a lower margin 48 that is also oriented transversely with respect to the elongate lighting element 12, and along which the structure 42 is coupled to the upper surface 46 of the base 40. In the exemplary embodiment of FIG. 1, structure 42 bears a fanciful holiday-themed decorative image, which is formed in relief and which, in this instance, gives the structure 42 the appearance (in the FIG. 1 front view) of a bat with fangs bared. Alternative images may be formed/employed, as will be readily apparent to persons skilled in the art. The significance and function of the base 40 of the hilt 14, and of the transverse connection between the device 42 and the base 40, are discussed in greater detail hereinafter.

In the exemplary embodiment of FIG. 1, handle 16 of the lighting unit 10 has a straight, rod-like shape, and is at least partially hollow so as to define a battery chamber (not shown) for receiving and retaining at least one battery (not shown). Handle 16 also defines an upper end 50, a removable cap 52 located at the upper end (thus providing access to the battery chamber for battery insertion and/or replacement), a lower end 54, and a peripheral surface 56 extending between the upper and lower ends 50, 54. The handle 16 and the peripheral surface 56 thereof extend substantially axially with respect to the elongate lighting element 12. The handle 16 is coupled, at its lower end 54, to the upper surface 46 of the base 40. The structure 42 is affixed to the handle 16 along an axial line extending a substantial portion of the length of the peripheral surface 56. The significance and function of the handle 16, and of the axially-oriented connection between the structure 42 and the handle 16, are discussed in greater detail hereinafter.

The control switch 18, usable for controlling light generation and lighting patterns generated by the disclosed lighting unit 10 is located on the handle 16. More particularly, the control switch 18 is typically a spring-return button 58 disposed in an aperture 60 formed in the peripheral surface 56 of the handle 16, although alternative switching mechanisms, e.g., a toggle switch, slide switch or the like, may be employed without departing from the spirit or scope of the present disclosure.

Referring now to FIG. 3, the substantially cylindrical shape of exemplary rod-like section 20 of the elongate lighting element 12 (FIG. 1), and the regularly spaced peripheral arrangement of the channels 30 and the elongate surfaces 32, are shown more clearly (but not to scale). In exemplary embodiments of the present disclosure, the rod-like section 20 includes structural wall segments 62 (with which the channels 30 are associated) and structural wall segments 64 (with which the elongate surfaces 32 are associated). Taken together, the structural wall segments 62, 64 define a central cavity 66 which extends along the length "L" (FIG. 1) of the rod-like section 20, making the rod-like section 20 substantially hollow. A light emitter 68 is contained and appropriately supported within the central cavity 66. The significance and function of the structural walls 62, 64 will be discussed in detail hereinafter, as will the structural and functional details of light emitter 68.

Figure 4:
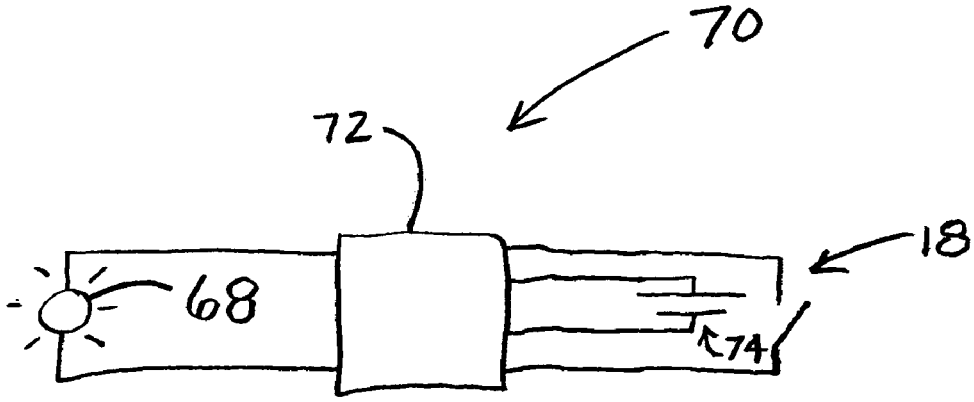
FIG. 4 is a schematic electrical diagram of the lighting unit of FIG. 1.

The lighting unit 10 includes an electrical circuit 70, a schematic diagram of which provided in FIG. 4. The circuit 70 includes conventional components that are designed/configured to deliver desired lighting functionalities. With further reference to FIG. 4, an electronic controller 72, light emitter 68, control switch 18, and a source 74 of DC power (e.g., battery power) cooperate with circuit 70. In exemplary embodiments of the present disclosure, the controller 72 is contained within the handle 16 (FIG. 2), and is electrically interconnected with the light emitter 68 by conductors, e.g., wires (not shown), passing between the handle 16 and the elongate lighting element 12. In accordance with such embodiments, the controller 72 controls the illuminative operation of the light emitter 68. For example, the controller 72 may be used to cause the light generated by the light emitter 68 to morph, strobe, flash, and/or hold on any one color. In some such embodiments, and/or in other exemplary embodiments, the controller 72 further includes a sound chip (not separately shown) equipped with a motion or sound sensor which will activate a sound when it detects a motion or sound. The sound so activated can be predetermined/prerecorded (e.g., during manufacture). Alternatively, such sound may be recorded by the user via a "record your own" feature incorporated within the sound chip.

The operation of the electrical circuit 70 will now be discussed, followed by a description of how the lighting unit 10 is used to provide internal illumination for a Jack-O-Lantern pumpkin.

Referring to FIGS. 2 and 4, the controller 72 regulates the transmission of power to the light emitter 68. User actuation of the pushbutton 58 inward and/or outward of the aperture 60 in the handle 16 causes the control switch 18 to become closed and/or opened, respectively. Such actuation induces mode changes in the controller 72 which, in turn, places the light emitter 68 in, and/or cycles the light emitter 68 through, one or more of numerous respective states of illumination, according to the manner and/or the pattern of such actuation. In accordance with various user-selectable modes of the controller 72, the light emitter 68 is caused, among other variations, to:

1) emit light of a constant hue and intensity;
2) emit multiple light hues simultaneously;
3) emit light of varying intensity over time;
4) emit light in a flashing pattern;
5) emit light that emerges from the light element 12 from multiple locations along its length, including the tip 22 thereof;
6) emit light that has an intensity that is constant but a hue which varies over time; and/or
7) emit no light whatsoever (i.e., an "off" mode).

Light emitted by the light emitter 68 passes outward of the elongate lighting element 12 via the structural walls 62, 64 of the rod-like section 20, as well as via similar structural walls (not separately shown) which form the tip 22. The plastic material of which the elongate lighting element 12 is generally fabricated is typically translucent or transparent (in whole or in part), thereby permitting most and/or substantially all of the light emitted by the light emitter 68 to be used for illumination purposes. The plastic material may be fabricated so as to impart lighting of a desired color or hue, e.g., by including a desired dye, colorant or the like in the molding process.

Figure 5:
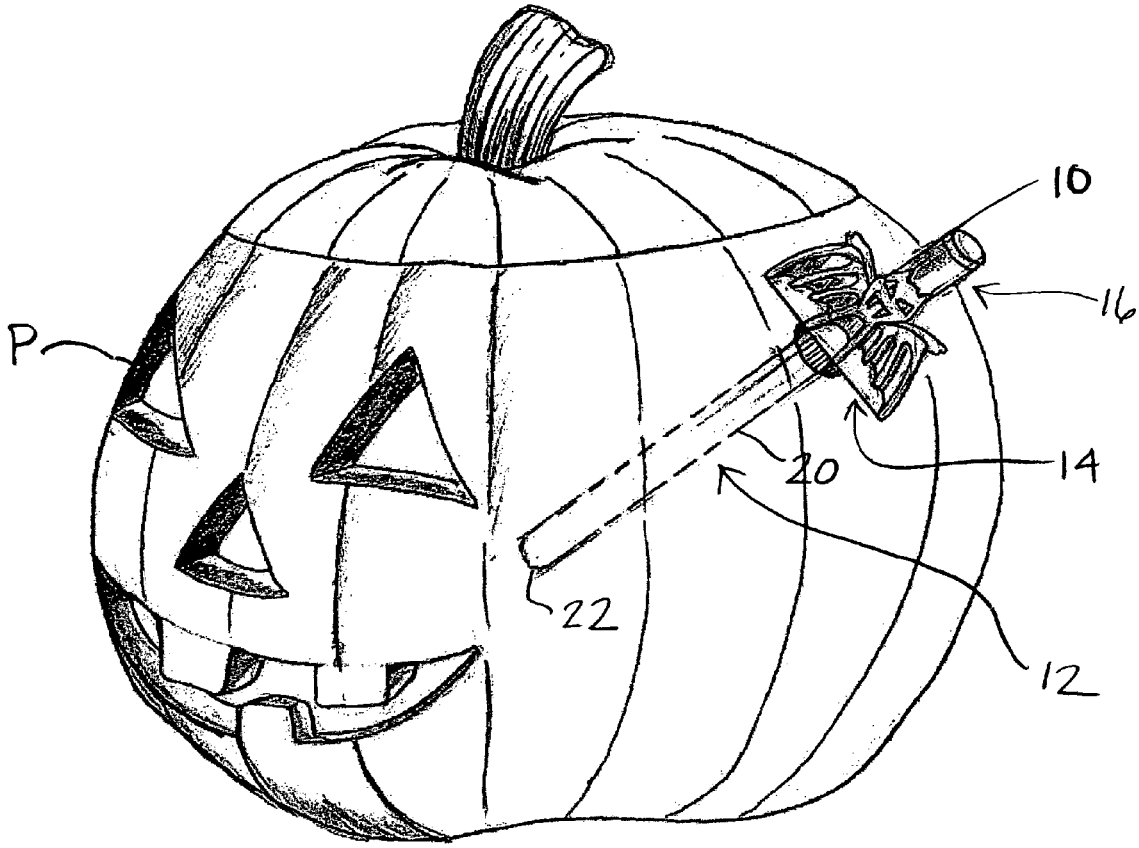
FIG. 5 is a perspective view of a common pumpkin which has been carved into the form of a Jack-O-Lantern, and into which has been inserted an exemplary lighting unit according to the present disclosure.

Referring now to FIG. 5, the elongate lighting element 12 of the exemplary lighting unit 10 is adapted to be inserted directly through the outer skin and underlying flesh of a Jack-O-Lantern pumpkin "P" and into its hollowed-out interior, such that light which passes outward of the elongate lighting element 12 is effective to illuminate the Jack-O-Lantern pumpkin "P" from within. More particularly, the tip 22 and the rod-like section 20 of the elongate lighting element 12 are generally sized, shaped, and otherwise adapted to permit a user to:

1) apply or position the distal end 36 of the elongate lighting element 12 at a point on the outer skin of the pumpkin "P";
2) cause the tip 22 to break and/or pass through the skin of the pumpkin at the selected point and enter the pumpkin flesh by grasping the handle 16 and applying an appropriate force to the handle 16 and/or the hilt 14 (which force is transmitted to the tip 22 via the rod-like portion 20); and/or
3) force the tip 22 and the rod-like section 20 into and through the flesh of the pumpkin and, in the process, create a hole in the pumpkin of a size ideally suited for:
   a) sliding the elongate lighting element 12 into the hollowed-out interior of the pumpkin "P" (at least in part);
   b) securing the elongate lighting element 12 in place during subsequent illuminative operation of the lighting unit 10 through frictional interaction between the pumpkin wall and the outer periphery of the elongate lighting element 12; and/or
   c) maintaining the lighting unit 10 in a desired orientation and/or position relative to the pumpkin "P" for internal illumination thereof.

According to the present disclosure, numerous factors and/or design considerations influence the force required to introduce the elongate lighting element 12 through the wall of a pumpkin. Thus, for example, the strength, rigidity, wall thickness, surface treatment, and/or overall profile of the elongate lighting element 12 may be selected so as to facilitate introduction/passage of the elongate lighting element through a pumpkin wall. In addition, the presence and size of channels 30 may be selected so as to contribute to the lateral stiffness and stability of elongate lighting element 12, while also reducing overall friction during insertion. Moreover, the design and geometry of distal tip 22 generally affects the force requirements for introduction of lighting element 12 through a pumpkin wall. Thus, although the exemplary embodiment of FIG. 1 depicts a hemispheric, substantially blunt tip 22, alternative tip configurations may be employed to facilitate introduction/passage of elongate lighting element 12 through a pumpkin wall. Thus, for example, tip 22 may take the form of a pyramidal blade-like surface or other geometric design that facilitates puncture and/or passage through the pumpkin wall. Similarly, the radius "R" of the exemplary blunt tip 22 of FIG. 1 may be selected to enhance tip functionality. In addition, the geometry and/or surface features of the elongated lighting element 12 may be selected so as to limit the requisite hole size and encourage a tight, reliable interface between the lighting element 12 and the pumpkin wall.

The emblem or structure 42, in addition to having an advantageous decorative aspect, may also contribute advantageous stiffening to the overall design, thereby further permitting a user to apply force in sufficient quantity on the handle 16 to force the elongate lighting element 12 into and through the flesh of the pumpkin. More particularly, according to exemplary embodiments of the present disclosure, structure 42 is sufficiently thick relative to its breadth to contribute a desired level of stiffness to the overall design. Thus, structure 42, which is securely affixed relative to the base 40 of the hilt 14 and the handle 16, advantageously increases the overall stiffness/rigidity of the hilt 14 and handle 16 of the lighting unit 10. According to alternative embodiments of the present disclosure, structure 42 may be detachably mounted with respect to base 40/handle 16, thereby permitting a user to interchange various structures 42, as may be desired from time-to-time.

As mentioned hereinabove, the hilt end 24 of the rod-like section 22 is also generally secured relative to the base 44 of the hilt 14 such that the overall rigidity of the lighting unit 10 is well suited to the above-described pumpkin-piercing function. Such connection between the hilt 14 and the rod-like section 22 can be made in one or more of any number of suitable ways, e.g., via ultrasonic welding, bayonet coupling, etc., including but not limited to connections generally designed to resist the intrusion of water and/or other fluids into the interior of the lighting unit 10. Other structural features/connections of the lighting unit 10 may also be designed to support water-resistant operation, as will be readily apparent to persons skilled in the art.

In practice, a user typically pushes the elongate lighting element 12 into the pumpkin until the lower surface 44 of the base 40 of the hilt 14 contacts the skin of the pumpkin adjacent to the hole created and/or dilated by the elongate lighting element 12. According to exemplary embodiments of the present disclosure, the lower surface 44 is sufficiently flat, and the base 40 sufficiently stiff, such that the hilt 14 places a positive, reliable limit on the depth to which the lighting element 12 can be inserted into the pumpkin (i.e., a distance equivalent to the length "L" of elongate lighting element 12). Of note, it may be desirable for the user to make a pre-incision in the wall of the pumpkin, e.g., with a knife or the like. In such circumstance, the distal tip 22 of the elongate lighting element 12 may function to dilate the pumpkin wall for passage of the elongate lighting element 12 therethrough.

In at least one embodiment of the disclosed method, the angle formed by the rod-like section 22 of the elongate lighting element 12 and the nearby skin of the pumpkin during insertion of the former into the latter is approximately 90 degrees (i.e., perpendicular). In accordance with such embodiment/s, when the hilt 14 meets/abuts the pumpkin skin, the lower surface 44 of the base (which is oriented approximately perpendicular to the axis of the elongate lighting element 12) will ordinarily squarely (e.g., substantially tangentially) meet most or all of the pumpkin skin surrounding the hole. This limits the possibility that "free play" will exist (and/or subsequently develop) between the hilt 14 and the pumpkin. (Such free play can cause the skin and/or flesh of the pumpkin near the entry hole to deteriorate prematurely, particularly in situations in which the lighting unit 10 is to be removed from and/or reinserted into the pumpkin multiple times during the period of display.) Once the lighting unit 10 has been successfully inserted into the pumpkin P, the circuit 70 of the lighting unit 10 is operated by the user in the manner described above by actuating the pushbutton 58 (or other control structure), which remains conveniently outside the pumpkin by virtue of the depth-limiting function of the hilt 14, also described above. The user may use many different patterns of actuation, including multiple actuations, to select the particular lighting effect desired.

It should be understood that numerous advantages are provided by the lighting unit 10 constructed in accordance with the foregoing description. For example, in exemplary embodiments of the present disclosure, the penetrating tip 22 of the elongate lighting element 12 is blunt, i.e., fully rounded, thereby posing little to no risk of injury associated with inserting the elongate lighting element 12 into the pumpkin P. At the same time, the radius associated with the penetrating tip 22 is generally sufficiently small to provide the concentrated initial force necessary to break the skin of the pumpkin P and form the entry hole to be occupied by the rod-like section 22. In instances where a preliminary cut is formed in the wall of the pumpkin, dilation of the initial puncture is facilitated according to the present disclosure.

The fact that the lighting unit 10 serves as its own insertion tool also greatly simplifies the task of illuminating a Jack-O-Lantern pumpkin once the work of creating it is complete. In exemplary embodiments of the present disclosure, the structure 42 incorporated into/onto the hilt 14 stiffens the assembly while providing a decorative touch appropriate to the season. Other advantages are also provided.

It should also be noted that the lighting unit 10 as discussed hereinabove in conjunction with FIGS. 1-5 can have many variations and modifications. Among the different types of light-emitting elements 74 that can be employed are incandescent light bulbs, light-emitting diodes or LEDs, and/or other types of light-emitting components which can be powered by conventional battery power. The light-emitting element 74 can be one light-emitting component or multiple such components, and if the latter, such components can be arranged in one or more arrays composed of lights of different types and/or colors. Many other variations are possible.

In accordance with one modification of the lighting unit 10, the rod-like section 22 has a slight taper, rather than a constant diameter D, along its length and/or near the hilt 14, so as to provide a tighter fit and/or discourage unintentional dislodgement. Alternatively, or in addition, the a different kind of light source may be employed, such as a chemiluminescent light source, or a brighter light source than can be conveniently powered by an appropriate energy source (e.g., a neon light powered via a cord plugged into an A/C power outlet, a halogen light, etc.). Moreover, the lighting unit 10 can be used in manner/s similar to the method described hereinabove to illuminate enclosures other than real, hollowed-out pumpkins, including, but not limited to, artificial pumpkins made from PVC plastic.

Referring to FIG. 2, the pushbutton 58 of the control switch 18 need not necessarily be positioned in or on the peripheral surface 56 (e.g., the side) of the handle 16. For example, in accordance with an exemplary modification to lighting unit 10, the pushbutton 58 may be positioned at or near the upper end 50 of the handle 16 (e.g., the pushbutton 58 may be incorporated into the removable cap 52).

Figure 6:
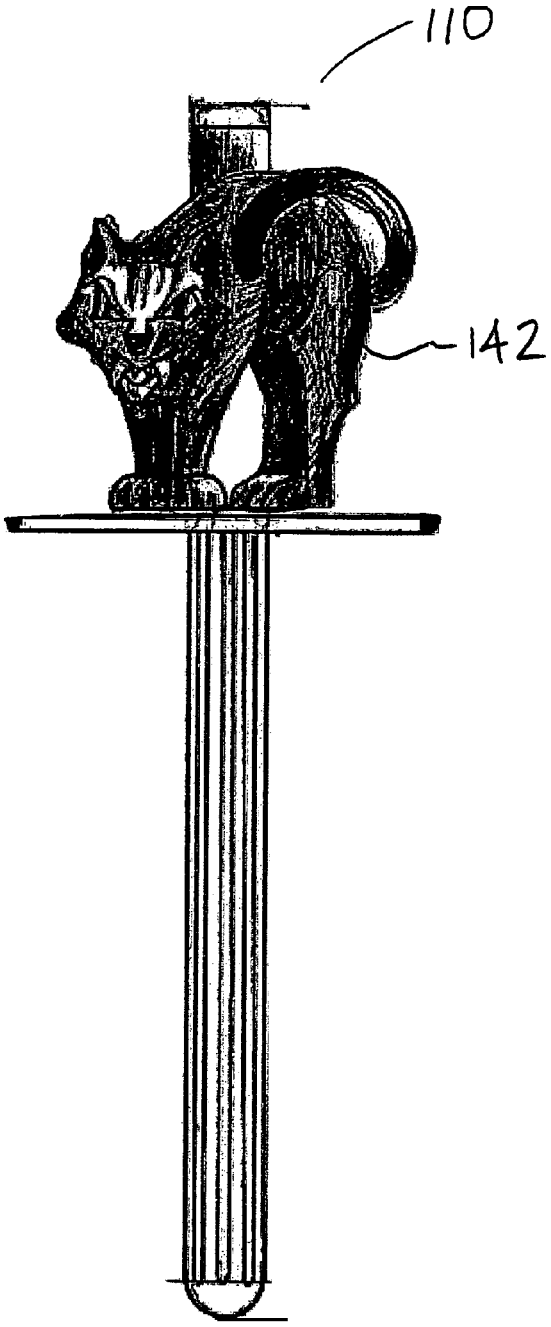
FIG. 6 is a front elevational view of a first variation of the exemplary lighting unit of FIG. 1.
Figure 7:
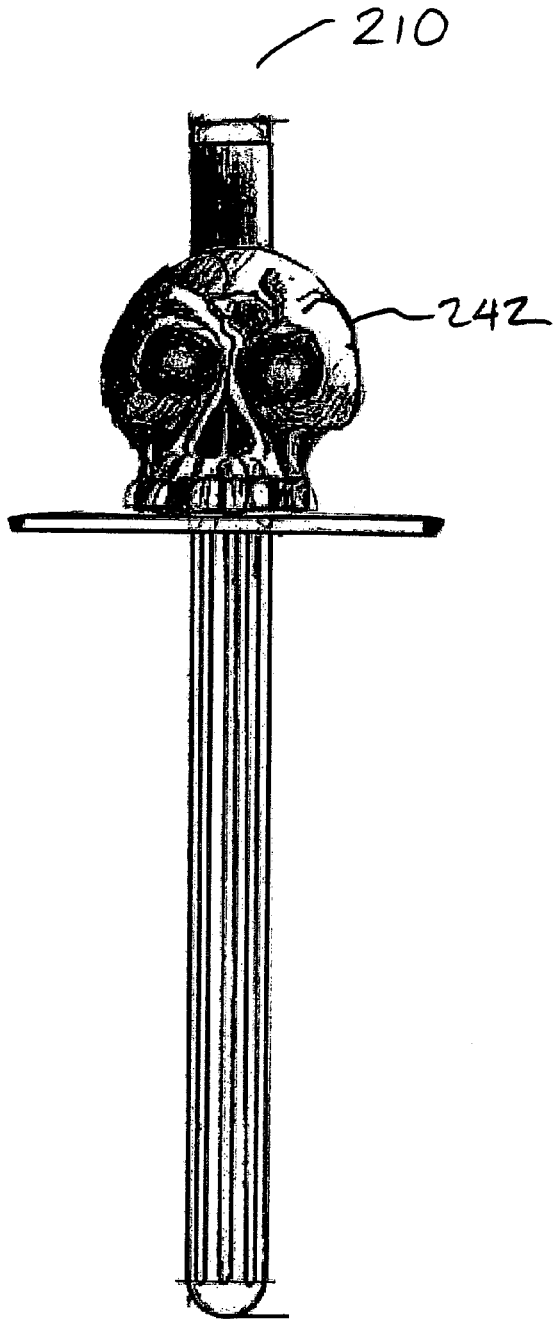
FIG. 7 is a front elevational view of a second variation of the exemplary lighting unit of FIG. 1.

Referring to FIGS. 6 and 7, further exemplary lighting units 110, 210 are schematically illustrated. Lighting units 110, 210 are similar to the lighting unit 10 described above with regard to FIGS. 1-5, including the presence of structures 142, 242 similar to the above described structure 42, except that the images formed in relief on structures 142, 242 are not that of a bat, but of a black cat, and of a partial skull, respectively. Other modifications are possible.

Although exemplary lighting units and combinations according to the present disclosure have been described with reference to illustrative embodiments thereof, the present disclosure is not limited to such disclosed illustrative embodiments. Rather, various changes, modifications and/or enhancements to the disclosed lighting elements/combinations may be made without departing from the spirit or scope of the present disclosure. All such changes, modifications and enhancements are included within the scope of the present invention as defined in the appended claims.

The invention claimed is:

1. In combination:

a lighting unit, the lighting unit including:

an elongate lighting element adapted to illuminate an interior space;

a hilt, the elongate lighting element being coupled to the hilt at an end of the elongate lighting element; and a control switch associated with the hilt; and a pumpkin defining said interior space and having an outer wall;

wherein the elongate lighting element of the lighting unit is configured and dimensioned to extend through the outer wall of the pumpkin into the interior space thereof to a depth determined by the hilt, and wherein the control switch is disposed external to the pumpkin when said lighting unit extends into the interior space so as to facilitate controlled internal illumination of the pumpkin.

2. A combination according to claim 1, wherein said elongate lighting element defines a tip and wherein said tip defines a geometric configuration selected from the group consisting of a hemispheric geometry and a pyramidal geometry.

3. A combination according to claim 1, wherein said elongate lighting element defines a tip and wherein said tip is a blunt shape.

4. A combination according to claim 1, wherein said elongate lighting element defines a tip and wherein said tip defines a hemispheric geometry having a minimum radius of less than about 0.5 inches.

5. A combination according to claim 1, wherein the elongate lighting element is cylindrical.

6. A combination according to claim 1, wherein the elongate lighting element includes longitudinal fluting.

7. A combination according to claim 6, wherein the elongate lighting element is cylindrical and wherein the longitudinal fluting defines circumferentially alternating surfaces and channels.

8. A combination according to claim 6, wherein the longitudinal fluting is axially oriented with respect to the elongate lighting element.

9. A combination according to claim 6, wherein the longitudinal fluting is helically oriented with respect to the elongate light element.

10. A combination according to claim 1, wherein the control switch communicates with a controller, and wherein the controller is adapted to cause the elongate lighting element to assume illumination modes selected from the group consisting of a morphing mode, a color-changing mode, a strobe mode, a flashing light mode, a constant-color mode, and combinations thereof.

11. A combination according to claim 1, wherein the elongate lighting element includes at least one light emitter selected from the group consisting of an incandescent bulb, a light emitting diode, a neon bulb, a halogen light source and combinations thereof.

12. A combination according to claim 1, wherein the hilt includes a decorative structure associated therewith.

13. A combination according to claim 12, wherein the decorative structure is mounted with respect to the hilt.

14. A combination according to claim 12, wherein the decorative structure defines a holiday-themed image.

15. A combination according to claim 14, wherein the holiday-themed image is formed in relief on the decorative structure.

16. A combination according to claim 12, wherein said decorative structure is substantially planar and functions to stiffen the hilt.

17. A combination according to claim 1, wherein the pumpkin is selected from the group consisting of a pumpkin gourd and a plastic enclosure.

18. A combination according to claim 1, wherein the hilt defines a stop that functions to control the depth to which the elongate lighting element extends into the interior space.

19. A method of illuminating a pumpkin formed from a common pumpkin gourd, said method comprising:

positioning a distal end of an elongate lighting element against the outer flesh of a pumpkin;

pushing the distal end into the outer flesh of the pumpkin so as to cause the distal end to pass through the outer flesh and into an interior space of the pumpkin such that a portion of the elongate lighting element passes through a hole and into the interior space of the pumpkin; and actuating a control switch disposed outside the pumpkin so as to cause the elongate lighting element to become illuminated, and to thereby illuminate the interior space of the pumpkin.

20. A method according to claim 19, wherein said distal end of said elongate lighting element defines a tip and wherein said tip defines a geometric configuration selected from the group consisting of a hemispheric geometry and a pyramidal geometry.

21. A method according to claim 19, wherein said distal end of said elongate lighting element defines a tip and wherein said tip is a blunt shape.

22. A method according to claim 19, wherein the elongate lighting element includes longitudinal fluting.

23. A method according to claim 19, wherein the control switch communicates with a controller, and wherein the controller is adapted to cause the elongate lighting element to assume illumination modes selected from the group consisting of a morphing mode, a color-changing mode, a strobe mode, a flashing light mode, a constant-color mode, and combinations thereof.

24. A method according to claim 19, wherein the elongate lighting element includes at least one light emitter selected from the group consisting of an incandescent bulb, a light emitting diode, a neon bulb, a halogen light source and combinations thereof.

25. A method according to claim 19, wherein the hilt includes a decorative structure associated therewith.

26. A method according to claim 25, wherein the decorative structure defines a holiday-themed image.

27. A method according to claim 19, wherein the elongate lighting element creates the hole in the pumpkin.

28. A method according to claim 19, wherein the elongate lighting element dilates the hole in the pumpkin.

29. A method according to claim 19, further comprising making a pre-incision in the outer flesh of the pumpkin to define the hole, and wherein the elongate lighting element dilates the hole in the pumpkin.

* * * * *